United States Patent [19]

Zyki, Jr.

[11] Patent Number: 4,507,814

[45] Date of Patent: Apr. 2, 1985

[54] PATIENT LIFT

[76] Inventor: Leonard C. Zyki, Jr., 8204 Greenshire Dr., Tampa, Fla. 33614

[21] Appl. No.: 504,898

[22] Filed: Jun. 16, 1983

[51] Int. Cl.[3] ..... A61G 7/10

[52] U.S. Cl. ..... 5/84; 5/81 R; 5/89

[58] Field of Search ..... 5/81 R, 82 B, 83, 84, 5/88, 89

[56] References Cited

U.S. PATENT DOCUMENTS

| | | | |
|---|---|---|---|
| 1,078,090 | 11/1913 | Foss | 5/81 R |
| 1,197,472 | 9/1916 | Foy | 5/89 |
| 2,323,500 | 7/1943 | Trigg | 5/81 R |
| 3,099,842 | 8/1963 | Jensen | 5/89 |
| 3,458,878 | 8/1969 | Combs | 5/81 R |

FOREIGN PATENT DOCUMENTS

| | | | |
|---|---|---|---|
| 81455 | 7/1952 | Norway | 5/84 |

*Primary Examiner*—Alexander Grosz
*Assistant Examiner*—Michael F. Trettel
*Attorney, Agent, or Firm*—Duckworth, Allen, Dyer & Pettis

[57] ABSTRACT

A patient lift device of the type primarily intended for use in combination with a bed having opposing side rails and a mattress therebetween wherein the lift device comprises a continuous length of strapping, or web material. A first end of the strap is fixed to the bed frame, and the body of the strap then passes over the top of a first side rail, across the top of the mattress and over the top of the second side rail. The strap is then looped back on itself to form a depending loop on the second side of the bed, and the strap crosses back over the second bed rail, across the mattress, and finally over the first bed rail. Then, both the first and second ends of the strap are fixed to the bed frame. A downward force on the loop formed on the other side of the bed will draw both segments of this strap tight and lift a patient lying thereacross. The patient lift device further includes a hook and eye construction so that the strap can be fixed in its drawn position to hold the patient above the mattress without having to maintain continuous downward pressure on the loop.

5 Claims, 4 Drawing Figures

PATIENT LIFT

BACKGROUND OF THE INVENTION

1. Field of the Invention

The present invention relates to a simple, economical, and efficient means for lifting a patient from his bed so that, for example, bed pans may be inserted and removed, dressings may be changed or bed linens may be changed.

2. Description of the Prior Art

When one is caring for an invalid or bed-ridden patient, it is often necessary either to lift the patient for the purpose of placing on a bed pan, changing bed clothes or linens, or to turn the patient for the purpose of preventing bed sores. While there are numerous, expensive and sophisticated apparati for accomplishing such movement in hospital installations or intensive care and burn units, there is very little available for private use, or by the use of which a single individual can lift and/or move a patient safely and conveniently. Of course, the problems associated with moving an invalid, or bed-ridden, patient are not new, and there are numerous patented prior art devices for solving this problem.

For example, U.S. Pat. No. 3,905,055 to Blair discloses a patient lift and support for a hospital bed utilizing flexible netting to lift the patient above the bed's mattress. The device of the Blair patent is both useful and economical, but its construction requires that the patient actually be lifted by the arm strength of the user. A somewhat similar device for moving patients is disclosed in U.S. Pat. No. 3,383,717 to Underwood. Using the device of this patent, either a two-step procedure would be necessary, or two individuals would be necessary to accomplish the lifting operation. In fact, the Underwood device is quite similar to the Blair device with the primary difference being that Blair does disclose a ratchet-type mechanism for winding the flexible net support member around a horizontal frame.

U.S. Pat. No. 3,458,878 to Combs does teach a device useful for moving bed patients which is certainly simple, from a mechanical point of view, and is suitable for private use. According to the Combs teaching, a strap is placed across the mattress beneath the patient, and one end of the strap is fixed to a side rail of the bed. The other end of the strap is grasped and pulled by the user for the purpose of causing the patient to move. In an alternate embodiment, the strap is configured to define a sling, or saddle, so that a seated patient can actually be lifted from the mattress when the free end of the strap is grasped and pulled by two persons. The Combs device is certainly suitable for moving a patient and is also economical in that it involves no moving parts; however, use of this device would require an operator of relatively great upper body and arm strength. Furthermore, no means are disclosed or suggested in Combs for maintaining the patient, or any part of the patient's body, in an elevated position other than by maintaining a pulling force on the free end of the strap.

Other examples of prior art devices utilizing mechanical means for raising, or moving, an invalid patient are disclosed in U.S. Pat. Nos. 359,728 to Knapp; 1,698,754 to Gadbois; and 3,673,620 to Saunders. Since all these devices do include mechanical parts, they ultimately depend upon substantial modification of the bed frame in order to accomodate the mechanical parts by which lifting of the patient is accomplished. It is therefore apparent from a consideration of the prior art as well as the personal experience of this inventor that there is a great need in the art for a simple, yet efficient, patient lift device of the type which can be utilized in combination with a standard bed frame having opposite side rails and a mattress therebetween.

Such a device should not only be capable of installation and use without structural modification of the bed, but it should also be capable of safe and efficient use, both for the patient and the operator, by a single person. Furthermore, positive means should be provided for holding the patient in an elevated position even after the operator ceases applying the force necessary to raise the patient from the bed.

SUMMARY OF THE INVENTION

The present invention is a patient lift device of the type primarily intended for use in combination with a bed frame having opposing side rails and a mattress therebetween. More specifically, the patient lift of this invention is intended for use in combination with standard beds having side rails, and may be utilized by a single person for the purpose of lifting an invalid patient from the mattress so as to permit changing of the bed linens, the patient's dressings, or for shifting the patient's position. The patient lift of this invention is characterized by its simple, basically nonmechanical construction and the fact that it can be utilized by a single person, or operator, even if that person does not possess significant upper body strength.

Most simply stated, the patient lift of this invention comprises a continuous elongated strap of web material such as, for example, the sort of belting normally used for automotive safety belts. A first end of the strap extends downwardly from a first side rail of the bed to define a first strap end outside the bed and substantially adjacent a portion of the bed's frame. Extending from this first strap end is a first strap segment which passes over the top of the first side rail and from there downwardly and across the mattress. The segment then passes up and over the top of the second bed rail. This first segment then continues downwardly along the outside of the bed and is then looped back upon itself to define a second strap segment.

In a similar fashion to the first segment, the second strap segment then passes up and over the top of the second bed rail and down to the mattress. The second segment continues across the top of the mattress, up and over the first bed rail, and downwardly outside the bed to terminate in a second end along side the first strap end. In a first embodiment, the first strap end further includes a buckle, and the second strap end includes a plurality of aperatures formed therethrough. Either the first or second strap end is passed around a fixed portion of the bed frame, and the two ends are joined together.

Alternatively, as is described in greater detail hereinafter with regard to a second embodiment of the patient lift, each of the first and second ends may comprise respective first and second buckles movably disposed thereon. In this second embodiment, a portion of the first strap would be passed around the bed frame and inserted into its corresponding first buckle. The second end segment would be similarly fixed around the bed frame. Thus, in either the first or second embodiment of the invention the distal ends of the strap are fixed to one side of the bed frame, and a loop is formed on the opposite side of the bed frame.

The patient lift further comprises a stirrup means movably mounted on the strap and extending from the loop. The stirrup means comprises a foot ring having an eye formed therewith and a hook mounted on the bed frame. To use the patient lift, a person merely places one foot in the foot ring and steps downwardly. Because the first and second ends of the strap are fixed to the bed frame on the opposite side of the bed, this will pull the first and second strap segments in an upward direction with respect to the top of the mattress causing a patient reclining thereacross to be raised. If desired, the user may engage the hook mounted on the bed frame with the eye formed on the stirrup means to hold the patient in an elevated position without the necessity of maintaining a downward force on the stirrup. It is of course to be understood that the patient would be lowered by first stepping downwardly on the foot ring to release the eye from the hook, and then gradually removing the downward force from the foot ring so as to permit the patient to be lowered to the mattress surface as the first and second strap segments move downwardly toward the mattress.

With regard to the two embodiments described above, it is to be understood that the first and second strap segments are spaced apart one from the other as they extend transversely beneath the patient and across the top of the mattress. Actual use of the patient lift of this invention has indicated that the distance between the first and second strap segments should be at least about six inches.

Though not required for proper operation and utilization of the patient lift of this invention, it has also been determined that the use of a sleeve around the first and second strap segments may be desirable. The construction of the sleeve may be thought of as a pillow case having both ends open. That is to say, the sleeve means may be formed from a flexible tublar material, preferably of a type along which the strap means will readily slide. This sleeve is disposed in surrounding relation around the first and second strap segments and extends therebetween. While use of the sleeve is not mandatory, it does provide a greater measure of support to the patient and does seem to increase patient comfort during the lifting operation.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For full understanding of the nature and objects of the invention, reference should be had to the following detailed description taken in connection with the accompanying drawings, in which.

Similar reference characters refer to similar parts throughout the several views of the drawings.

DETAILED DESCRIPTION

Figure 1:
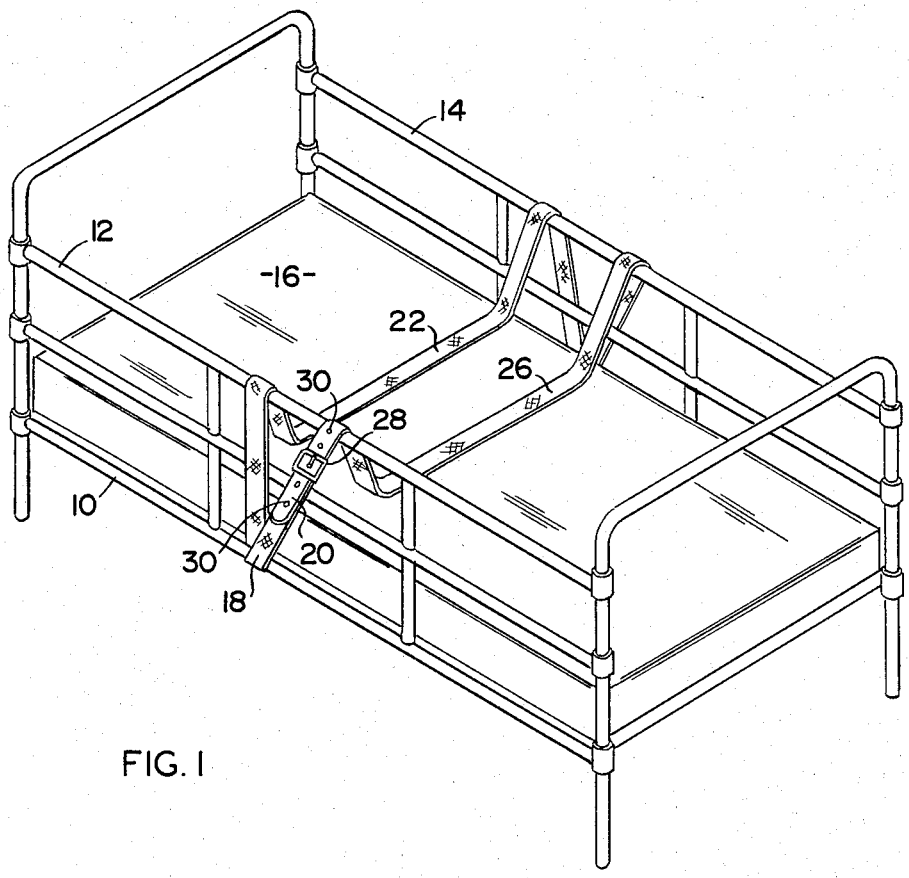
FIG. 1 is a perspective view of a first embodiment of the invention.

A first embodiment of the patient lift device of this invention is generally illustrated in the view of FIG. 1. As can be seen in that figure, as well as the alternate views of FIGS. 2 and 3, the patient lift is of the type primarily intended for use in combination with a bed frame 10 having opposing first side rail 12 and second side rail 14. A mattress 16 rests on frame 10 and extends between first and second side rails 12 and 14. The patient lift basically comprises a strap means defined by a length of web material having a first end 18 and a second end 20.

First end 18 depends downwardly over the outside of first side rail 12 and extending therefrom is a first segment 22 which depends downwardly over the inside of first side rail 12, across the top of mattress 16, and then upwardly and over the second side rail 14 and downwardly therefrom.

Figure 2:
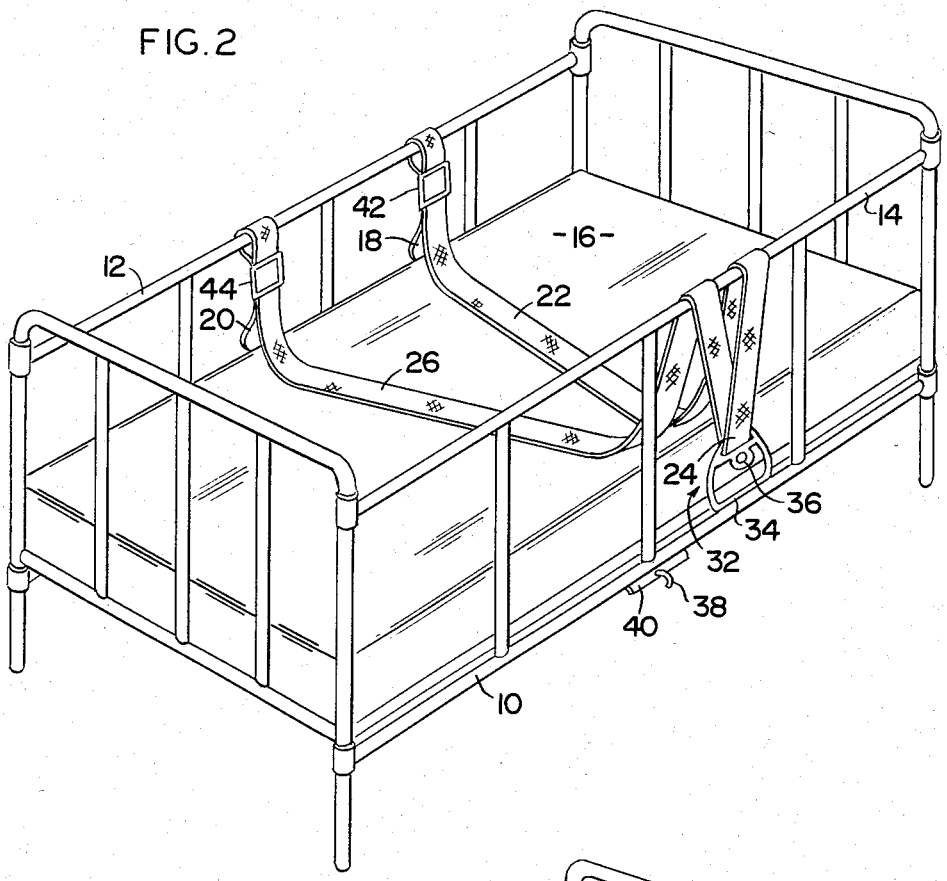
FIG. 2 is a perspective view of a second embodiment of the invention.
Figure 3:
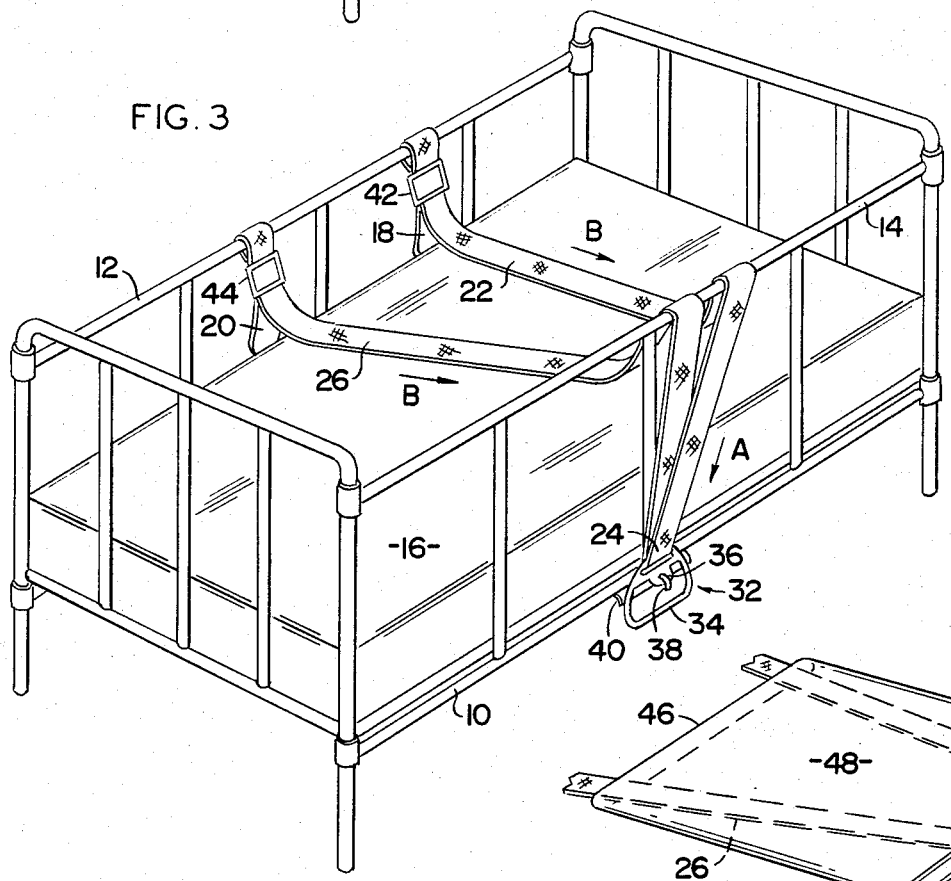
FIG. 3 is a perspective view similar to that of FIG. 2 showing the invention in its lift position.

Though not visible in the view of FIG. 1, in the views of FIGS. 2 and 3, it can be seen that the strap means is turned back upon itself to define a loop 24 which further defines the beginning of a second segment 26. Second segment 26 extends upwardly from loop 24, over the second side rail 14 and across mattress 16. Second segment 26 then extends upwardly and over the first side rail 12 and downwardly therefrom to the second end 20.

Still with regard to the view of FIG. 1, it can be seen that the patient lift device of this invention further comprises means for fixing first end 18 and second end 20 to the bed frame 10. In this embodiment, the means for fixing comprises a buckle 28 mounted on first end 18 and a plurality of apertures 30 formed through second end 20. Thus, first end 18 and second end 20 may be joined to each other around a portion of bed frame 10. Thus, one side of the patient lift device defined by first and second ends 18 and 20 is fixed to bed frame 10, while the opposite side of the patient lift device as defined by loop 24 hangs freely over second rail 14. Attention is now invited to the view of FIGS. 2 and 3 with regard to additional structural elements common to all embodiments of the patient lift device as well as to a second embodiment of the means for fixing first and second ends 18 and 20 to the bed.

In the views of FIGS. 2 and 3, structural elements substantially identical to those of the embodiment shown in FIG. 1 have been numbered accordingly. First, it can be seen that the patient lift device further comprises stirrup means, generally indicated as 32, movably mounted on the strap at loop 24. Stirrup means 32 comprises a foot ring 34 and an eye 36, and a hook 38 mounted on bed frame 10 as by bracket 40. A single operator may use the device of this invention conveniently and safely by placing his foot within foot ring 34 and applying a downward force as indicated by arrow A in the view of FIG. 3. Such downward force will cause first strap segment 22 and second strap segment 26 to traverse the top of mattress 16 as indicated by directional arrows B, resulting in the application of a lifting force to a patient lying on mattress 16 across first segment 22 and second segment 26.

It can also be seen that upon engaging eye 36 with hook 38, the device of this invention will be held in its "lift" position without the necessity of the operator's continuing to apply a downward force. Thus, the patient is positively and safely held in an elevated position so that the operator is free to perform necessary tasks such as, for example, insertion and removal of a bed pan, changing the bed linen, the patient's dressings, or altering the patient's position with respect to the bed. It is to be understood that eye 36 of stirrup means 32 may be intergrally formed as shown, or may comprise a second, generally smaller ring disposed at loop 24.

Still with regard to the views of FIGS. 2 and 3, alternate means for fixing first end 18 and second end 20 to the bed are disclosed. At this point it should be noted that while the views of FIGS. 2 and 3 show fixing first and second ends 18 and 20 around the first bed rail 12, this is primarily for purposes of clarity. Inasmuch as the rails 12 and 14 are generally not as mechanically sound as is frame 10, it is actually preferred to fix ends 18 and 20 around a portion of frame 10. Nevertheless, the means for fixing would be just as is shown in FIGS. 2 and 3. In this embodiment, the means for fixing comprises a first buckle 42 movably disposed on first segment 22 adjacent first end 18. First end 18 may be received and engaged by first buckle 42 as shown in FIGS. 2 and 3. A second buckle 44 is similarly disposed on second segment 26 adjacent second end 20 for receiving and engaging second end 20 therethrough. Thus, by virtue of this construction of the means for fixing, each of the first and second ends 18 and 20 may be individually secured to the bed.

Figure 4:
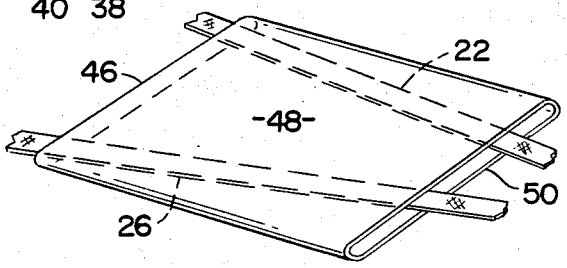
FIG. 4 illustrates the sleeve means of this invention.

Finally, attention is invited to the fragmentary view of FIG. 4 wherein it can be seen that the patient lift device of this invention may further comprise a sleeve 46 movably disposed around corresponding portions of first segment 22 and second segment 26. Sleeve 46 is preferably formed from a flexible material in a tubular configuration, and the material should be of a nature and quality so as to slide along segments 22 and 26 with relatively little resistance. The patient would of course, engage top surface 48 of sleeve 46, while bottom surface 50 would lie in juxtaposition with the top of mattress 16. The primary benefits derived from the use of sleeve means 46 are additional support and comfort to the patient as well as a greater sense of security to the patient when he or she is being lifted.

Having thus set forth the best modes known for practicing this invention, it will be seen that the objects set forth above, among those made apparent from the preceding description, are efficiently attained, and since certain changes may be made in the above constructions without departing from the scope of the invention, it is intended that all matter contained in the above description are shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A patient lift of the type primarily intended for use in combination with a bed frame having opposing side rails and a mattress therebetween, said patient lift comprising: a strap means defined by a length of web material having first and second ends; said first end depending downwardly over the outside of a first bed side rail; a first segment of said strap means depending downwardly over the inside of the first bed side rail, across the mattress, and then upwardly and over the second bed side rail and downwardly therefrom; a loop formed in said strap means to define the beginning of a second segment of said strap means; said second segment extending upwardly from said loop, over said second bed side rail, across the mattress, and then upwardly and over the first bed side rail and downwardly therefrom to said second end; means for fixing said first and second ends to the bed frame; and stirrup means movably mounted on said strap means at said loop, whereby a patient reclining across said first and second segments on the mattress may be lifted therefrom by applying a downward force to said stirrup means, said stirrup means comprising a foot ring having an eye formed therewith and a hook mounted on the bed frame, whereby the patient may be held in an elevated position by engaging said hook in said eye after stepping downwardly on said foot ring.

2. A patient lift as in claim 1 wherein said means for fixing comprises a buckle mounted on said first end and a plurality of apertures formed through said second end, whereby said first and second ends may be joined to each other.

3. A patient lift as in claim 1 wherein said means for fixing comprises a first buckle movably disposed on said first segment adjacent said first end for receiving and engaging said first end therethrough, and a second buckle movably disposed on said second segment adjacent said second end for receiving and engaging said second end therethrough, whereby said first and second ends may be individually secured to the bed frame.

4. A patient lift as in claim 1 further comprising sleeve means movably disposed around corresponding portions of said first and second segments in juxtaposition to the mattress and extending between said portions of said first and second segments.

5. A patient lift as in claim 4 wherein said sleeve means comprises a flexible tubular sleeve.

* * * * *